United States Patent [19]

Wright

[11] 4,309,930

[45] Jan. 12, 1982

[54] BLADE GUIDE

[75] Inventor: Stephen C. Wright, Bettendorf, Iowa

[73] Assignee: Hansaloy Corporation, Davenport, Iowa

[21] Appl. No.: 146,978

[22] Filed: May 5, 1980

[51] Int. Cl.[3] ..... B26D 1/54

[52] U.S. Cl. ..... 83/820; 83/807; 83/808; 83/821

[58] Field of Search ..... 83/807, 808, 820, 821

[56] References Cited

U.S. PATENT DOCUMENTS

| | | | |
|---|---|---|---|
| 1,453,335 | 5/1923 | Bennett | 83/820 X |
| 2,022,187 | 11/1935 | Criner . | |
| 2,134,105 | 10/1938 | Criner . | |
| 2,205,527 | 6/1940 | Hartman . | |
| 2,434,884 | 1/1948 | Kottmann et al. . | |
| 2,809,681 | 10/1957 | Boitscha | 83/807 X |
| 2,809,681 | 10/1957 | Boitscha . | |
| 2,984,275 | 5/1961 | Patterson . | |
| 3,145,745 | 8/1964 | Benith | 83/808 X |
| 3,638,521 | 2/1972 | Marckx et al. . | |
| 3,817,142 | 6/1974 | Fingerle et al. | 83/820 |
| 4,179,966 | 12/1979 | Ginnow et al. | 83/820 |

OTHER PUBLICATIONS

Hansaloy Products Catalog, (effective 4-1-79).
Hartman Blade Guide; Hartman/Main Machine Works.
Pak-It Blade Guide; Pak-It Mfg. Co., Inc.

*Primary Examiner*—Donald R. Schran
*Attorney, Agent, or Firm*—Henderson & Sturm

[57] ABSTRACT

The blade guide invention relates to devices employed in bread slicing machines to guide band blades. Mounting to increase cutting accuracy and providing for increased life and reduced tendency to seize the band blades is achieved by a blade guide (11) with body, guide and attachment portions (16, 17, 18) formed in a unitary construction. The guide portion includes spaced apart prongs (19, 21, 22) with improved wear surfaces **(24, 31*a*, 31*b*) forming a channel (36*a*)** for the band blade.

8 Claims, 7 Drawing Figures

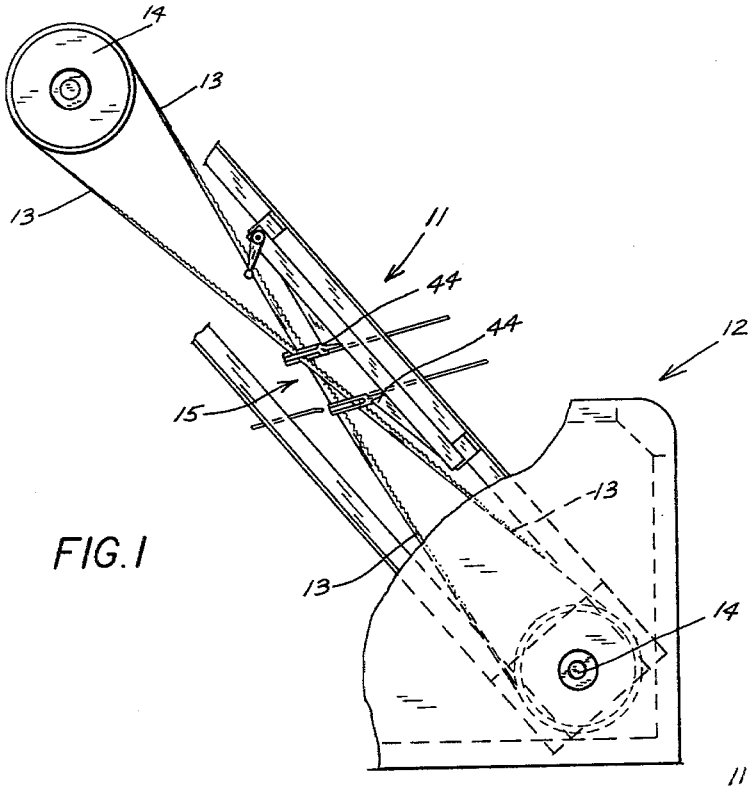
FIG. 1
FIG. 2
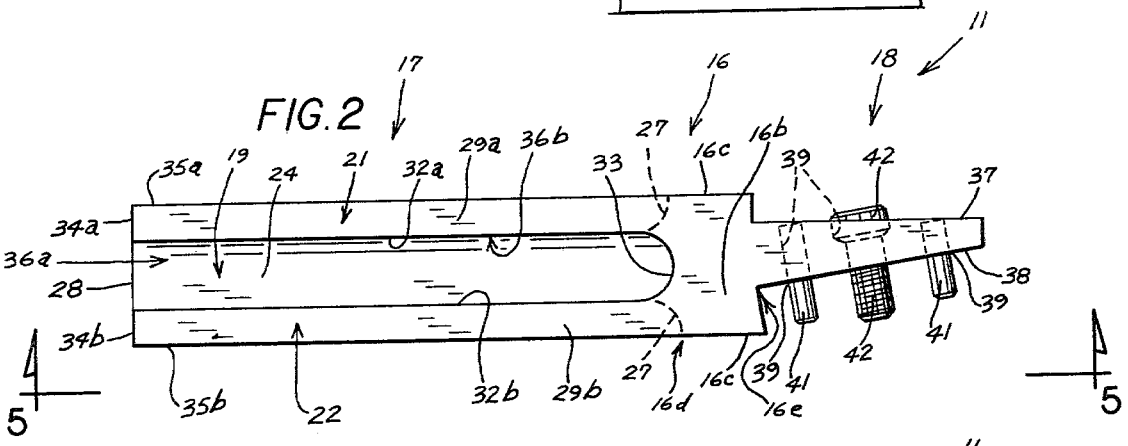
FIG. 5
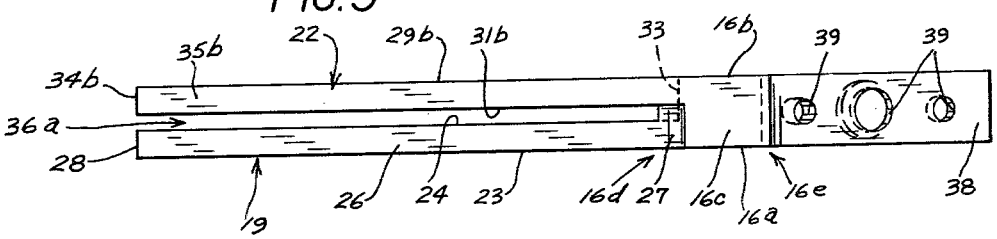

BLADE GUIDE

TECHNICAL FIELD

This invention relates generally to bread slicing machines employing band blades. More particularly, this invention relates to guide structures for positioning the band blades for proper slicing of bread loaves.

BACKGROUND ART

Slicing machines in the bakery industry generally comprise a pair of cylindrical drums which are spaced apart and drive a plurality of band blades extending therebetween. Typically the band blades are crossed between the drums, the blades appearing to have a figure "8" configuration when viewed from the side. The bread loaves are guided through the machine intermediate the drums and pass through the band blades in the zone where the blades are crossed. Each band blade passes through the bread twice, simultaneously, and in opposite directions.

The slicing machines typically have a multitude of guide fingers mounted between the drums and on each side of the blade crossover area. The purpose of the guide fingers is to twist each band blade such that the oppositely moving portions of the blade are parallel to each other and, in the usual case, are normal to the bread loaves while passing therethrough, whereby bread slices are produced of controlled thickness and with parallel surfaces. Twisting of the band blades is effected by certain surfaces of the guide fingers exerting pressure upon the band blades as the blades pass through the guide fingers.

Movement of the band blades against the guide finger surfaces causes both the blades and the blade guides to wear. Furthermore, friction causes heat to build up in the blade guides. Eventually, the blades become too dull to properly cut the bread loaves; and the blade guides tend to damage the blades and to break, or to seize the blades or to otherwise jam the bread slicing machine such as by collecting bread crumbs or the like.

To reduce the amount of wear, present blade guides have been provided with hard chrome wear surfaces. Some blade guides have been provided with carbide inserts for wear surfaces. Nevertheless, present blade guides typically have a useful life of approximately two years only. Furthermore, present blade guides are of multi-piece construction, silver-soldered together, which results in significant fabrication costs.

DISCLOSURE OF INVENTION

Responding to the needs described above, this invention provides a blade guide having a body portion. Guide and attachment portions are contiguous with the body portion, extending away from opposite ends of the body portion. The guide includes a plurality of prongs which define a channel within which the blade is received. The prongs bear treated wear surfaces.

It is an object of this invention to provide a blade guide of improved strength.

Another object of this invention is to provide a blade guide which more readily retains its proper alignment in a bread slicing machine.

Also an object of this invention is the provision of a blade guide having improved wear surfaces.

A further object of this invention is the provision of a blade guide which has superior heat dissipation characteristics and which resists accumulation thereon of bread crumbs and other materials.

Yet another object of this invention is provision of a blade guide having an increased useful life and a decreased tendency to clamp against the band blades or otherwise jam the the bread slicing machine.

Still another object of this invention is to provide a blade guide of such construction that flame spraying and boronzing techniques may be employed to achieve increased resistance to wear and longer useful life of portions thereof.

It is an object of this invention to provide a blade guide which is relatively inexpensive to fabricate yet is of sturdy construction and capable of achieving the aforementioned objects.

These objects and other features and advantages of this blade guide invention will become readily apparent upon referring to the following description in conjunction with the appended drawing.

BRIEF DESCRIPTION OF THE DRAWINGS

The blade guide invention is illustrated in the drawings wherein:

FIG. 1 is a fragmentary, side elevational view, showing portions of a bread slicing machine employing the blade guides of this invention;

FIG. 2 is an enlarged, elevational view of one side of the blade guide;

FIG. 5 is an enlarged, bottom plan view of the blade guide:

BEST MODE FOR CARRYING OUT THE INVENTION

Figure 4:
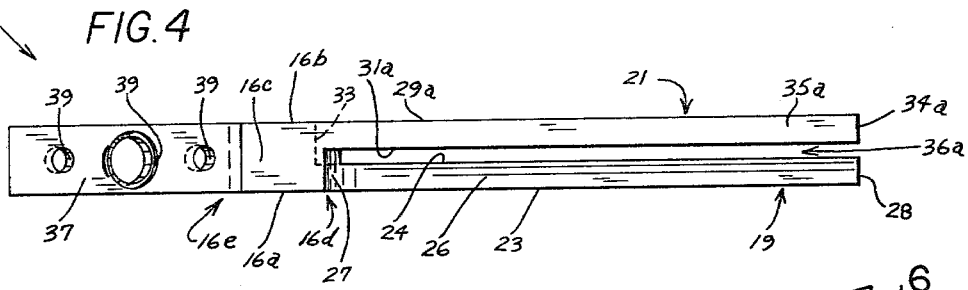
FIG. 4 is an enlarged, top plan view of the blade guide.
Figure 3:
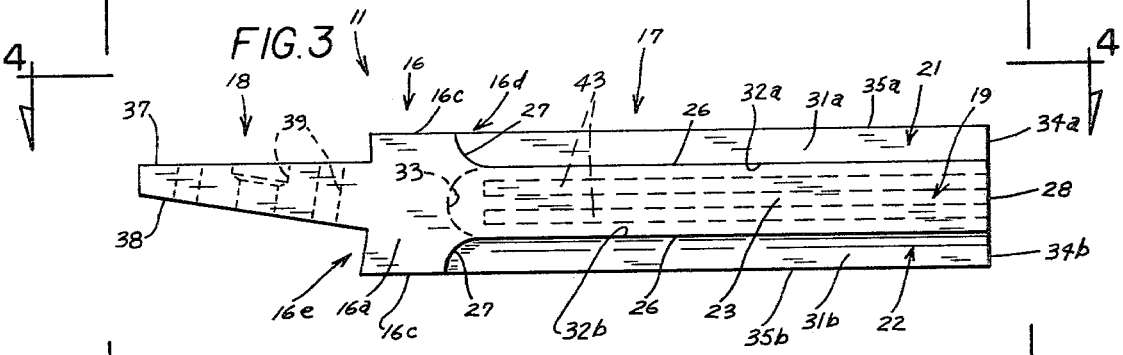
FIG. 3 is an enlarged, elevational view of the opposite side of the blade guide.
Figure 6:
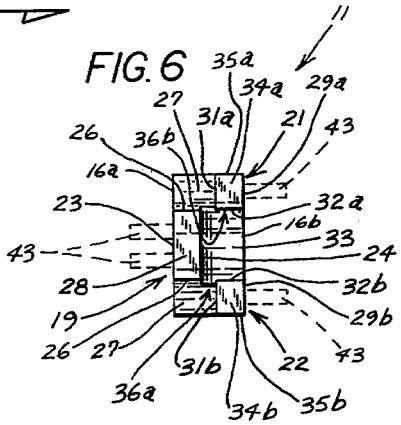
FIG. 6 is an enlarged, elevational view showing the free end of the blade guide.
Figure 7:
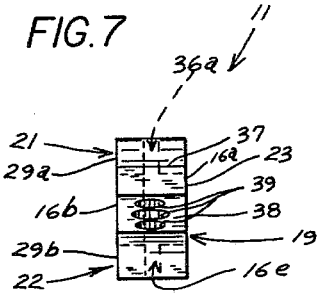
FIG. 7 is an enlarged, elevational view showing the fixed end of the blade guide.

The blade guide invention is shown generally at 11 in FIG. 1 positioned in a machine 12 for slicing bread. The machine 12 includes a plurality of band blades 13 disposed in side-by-side relationship. The blades 13 extend between, and are driven by, two rotating drums 14. Each blade 13 is mounted such that in side elevation it appears to "cross over", as at 15, thereby assuming a figure-8 configuration. The blade guide 11 is unitary in construction and more particularly includes body, guide and attachment portions 16, 17, 18.

The body 16 includes parallel side surfaces **16*a*, 16*b*. Upper and lower surfaces 16*c* extend between the side surfaces 16*a*, 16*b*. The body 16 also has front and rear end areas 16*d*, 16*e***.

The guide portion 17 includes first, second and third guide prongs 19, 21, 22 contiguous with, and extending from the front end **16*d* of, the body portion 16. The first guide prong 19 has an outside surface 23 flush with the surface 16*a* of the body portion 16. The prong 19 also has an inside wear surface 24. Longitudinal surfaces 26 of the prong 19 begin with arcuate portions 27 adjacent the body 16 and terminate at the extended free end 28. The prong 19 generally is rectangular in cross section, the dimension of the prong 19 between surfaces 26 being less than that between surfaces 16*c***.

The second and third guide prongs 21, 22 having outside surfaces **29*a*, 29*b* respectively which are flush with the surface 16b of body 16. The guide prongs 21, 22 have inside wear surfaces 31a, 31b. Inwardly facing longitudinal surfaces 32a, 32b begin at an arcuate contiguous surface 33 of the body front end 16d and terminate at free ends 34a, 34b. Outwardly facing longitudinal surfaces 35a, 35b begin adjacent body 16, flush with surfaces 16c, and terminate at the free ends 34a, 34b. The prongs 21, 22 generally are rectangular in cross section, the dimensions thereof between surfaces 32a, 35a, and between surfaces 32b, 35b being less than that between surfaces 16c**.

The guide prongs 19, 21, 22 are disposed such that the outside surfaces 23, 29a, 29b and wear surfaces 24, 31a, 31b are parallel. The prongs 21, 22 are disposed to one side, and the prong 19 to the opposite side, of a plane which bisects the body 16 and is parallel to surfaces 16a, 16b. A channel 36a is formed thereby between the prongs 19, 21, 22; and the wear surface 24 generally faces the wear surfaces 31a, 31b across the channel 36a. The guide prongs 21, 22 are disposed in side-by-side relationship such that a slot 36b is formed between longitudinal surfaces 32a, 32b. More particularly, the wear surface 24 is disposed directly opposite the slot 36b, the area of surface 24 being somewhat the same as that of slot 36b. The wear surfaces 31a, 31b more particularly are disposed opposite the spaces adjacent the longitudinal and arcuate surfaces 26, 27 of the first prong 19.

The attachment portion 18 extends from the body rear end 16e in the direction opposite that of the guide portion 17. The portion 18 includes a first surface 37 generally parallel to surfaces 16c, 26, 35a, 35b. Portion 18 also includes an opposite, mounting surface 38 disposed at an angle to the first surface 37. A plurality of bores 39 are formed through the portion 18, through the surfaces 37, 38. The longitudinal axes of the bores 39 are parallel to each other and normal to the surface 38. Guide pins 14 are received in the bores 39 adjacent the ends of portion 18, the pins 41 projecting away from surface 38. An attachment bolt 42 extends through the central bore 39, beyond surface 38, into the standard mounting structures of the slicing machine 12. The guide pins 41 may be cast, instead of pressed, into the bores 39.

The blade guide 11 is fabricated in one piece, preferably from high-carbon, chrome-vanadium steel. The wear surfaces 24, 31a, 31b are treated to form a metal carbide or a metal boride surface by flame spraying or boronzing techniques, respectively, known to those skilled in the art.

The blade guide 11 may be modified by the addition of a plurality of fins 43 to the prongs 19, 21, 22. The fins 43 are attached normal to the outside surfaces 23, 29a, 29b and extend parallel to the longitudinal axes of the guide prongs 19, 21, 22. Also, a blade guide 11 may be fabricated which would be the mirror image of the guide 11 as illustrated in the drawings.

The blade guides 11 are mounted in standard fashion, the surfaces 38 being disposed against the machine 12 mounting structures. The usual spacing adjustments are made to the guides 11 to effect the desired bread slice thickness. The band blades 13 are disposed through the channels 36a.

When the slicing machine 12 is in operation, the wear surfaces 24, 31a, 31b of the guides 11 press against the blades 13, thereby causing the blades 13 to be parallel in the cross-over area 15 through which the bread loaves are passing. The unitary construction of the guides 11 gives increased strength and steadier attachment and alignment at 44 in the machine 12, thereby facilitating an accurate and consistent bread slice thickness.

The metal carbide or metal boride wear surfaces 24, 31a, 31b have superior abrasion resistant properties, and this results in a greater useful life for the guides 11. Furthermore, the metal carbide or metal boride wear surfaces 24, 31a, 31b have a lower coefficient of friction run against the steel and therefore less heat is generated by friction during operation of the machine, thereby increasing the useful life of the band blades 13 and reducing the tendency of the guides 11 to seize the blades 13. The unitary construction of the blade guide 11 and the arrangement and conformation of the guide prongs 19, 21, 22 enable flame-spraying and boronzing techniques to be employed to create the superior wear surfaces 24, 31a, 31b.

The open arrangement of the prongs 19, 21, 22 also increase heat dissipation from the wear surfaces 24, 31a, 31b, reducing thermal expansion, extending blade guide 11 life and reducing the likelihood of jamming. The arrangement and configuration of the guide prongs 19, 21, 22 encourages bread crumbs and the like to fall out of the guides 11, thereby also reducing the likelihood of the guides 11 seizing the band blades 13.

The industrial applicability of this blade guide invention is believed to be apparent from the foregoing description. Although a preferred embodiment and modifications thereof have been disclosed herein, it is to be remembered that various alternate constructions can be made thereto without departing from the scope of this invention.

I claim:

1. A blade guide for use in bread slicing machines employing band blades, said guide comprising:

body means for attachment to a slicing machine; and means for guiding band blades, including first and second guide structures extending from said body means and forming a guide channel therebetween, said first guide structure including at least one first guide prong, said second guide structure including at least two second guide prongs, said first and second guide prongs having wear surfaces which face each other across said guide channel, said second guide prongs being spaced apart to form a slot communicating with said guide channel, said first guide prong being disposed such that said slot is across said guide channel from said first guide prong's wear surface, the band blade being received in said guide channel.

2. A blade guide for use in bread slicing machines employing band blades, said guide comprising:

body means for attachment to a slicing machine; and means for guiding band blades, including first and second guide structures extending from said body means and forming a guide channel therebetween, said first guide structure including at least one first guide prong, said second guide structure including at least two second guide prongs, said first and second guide prongs having wear surfaces which face each other across said guide channel, said first guide prong has longitudinal surface defining spaces disposed to each side of said first guide prong, said spaces communicating with said guide channel, said second guide prongs being disposed such that said spaces are across said guide channel from said second guide prong's wear surfaces, the band blade being received in said guide channel.

3. The blade guide of claim 1 or 2 and further wherein said wear surfaces are formed of a metal carbide.

4. The blade guide of claim 1 or 2 and further wherein said wear surfaces are formed of a metal boride.

5. The blade guide of claim 1 or 2 and further wherein said first and second guide prongs have surfaces directed away from said guide channel, said surfaces having a plurality of fins joined thereto.

6. The blade guide of claim 1 or 2 and further wherein said body means and means for guiding band blades form a unitary construction.

7. A blade guide for use in bread slicing machines employing band blades, said guide comprising:

unitary means having body means for attachment to a slicing machine and means for guiding band blades contiguous with said body means;

said means for guiding having a plurality of prongs and a guide channel disposed between said prongs, no prong being directly facing another prong across said guide channel, wear surfaces of hardened material being formed on said prongs.

8. The blade guide of claim 7 wherein the hardened material is metal carbide.

* * * * *